United States Patent [19]

Biren

[11] Patent Number: 4,921,433

[45] Date of Patent: May 1, 1990

[54] VARIABLE PORTABLE FEEDTHRU DEVICE

[75] Inventor: Theodore M. Biren, Osseo, Minn.

[73] Assignee: Cooper Power Systems, Inc., Houston, Tex.

[21] Appl. No.: 292,647

[22] Filed: Dec. 29, 1988

Related U.S. Application Data

[63] Continuation of Ser. No. 15,844, Feb. 17, 1987, abandoned.

[51] Int. Cl.[5] ..... H01R 13/60

[52] U.S. Cl. ..... 439/534; 439/569

[58] Field of Search ..... 439/534, 562–565, 439/569, 573, 574; 248/542, 224.4, 225.1

[56] References Cited

U.S. PATENT DOCUMENTS

| | | | |
|---|---|---|---|
| 1,081,378 | 12/1913 | Freeman | 248/223.4 |
| 3,662,297 | 3/1972 | Tachick et al. | 439/534 |
| 4,288,054 | 9/1981 | Schröder et al. | 248/225.1 |
| 4,558,839 | 12/1985 | Kaplan et al. | 248/223.1 X |
| 4,589,557 | 5/1986 | Bollmann | 248/225.1 X |

*Primary Examiner*—Eugene F. Desmond

*Attorney, Agent, or Firm*—Michael, Best & Friedrich

[57] ABSTRACT

A portable feedthru device is a means of parking an energized or deenergized high voltage underground cable at an electrical apparatus to bypass such an apparatus by feeding thru to other apparatus or to test and ground the parked cable to safely work on such cable.

A variable portable feedthru device is a device with a type of mounting bracket which allows the portable feedthru device to be used with any type accessory bracket. The variable portable feedthru device can be oriented in any plane to accommodate any cable position. The method of locking the variable portable feedthru device in its accessory bracket is to tighten the back plate against the accessory bracket by means of a screw to create a binding action. This will improve safety by firmly holding the portable feedthru device in its accessory bracket.

17 Claims, 2 Drawing Sheets

VARIABLE PORTABLE FEEDTHRU DEVICE

This is a continuation of application Ser. No. 015,844, filed Feb. 17, 1987, now abandoned.

BACKGROUND OF THE INVENTION

1. Field of the Invention

The present invention is concerned with the safety of construction and repair personnel when working on new or old electrical underground cables. The present invention is a device that will firmly hold the electrical cable in place.

2. Description of Prior Art

The vertical and horizontal portable feedthru devices now manufactured (see FIG. 5) cannot always be securely fastened in the accessory brackets or parking stands of some electrical apparatus as in FIG. 6. Many times the electrical cable and portable feedthru device to which it is attached will jump out of the accessory bracket because the portable feedthru device cannot be secure. Electrical underground cable seems to have a memory of the position and plane that the cable is normally held in. With the advent of the new jacketed electrical underground cable that the electric utility industry is now using, it will be even more important to be able to secure the portable feedthru device. This new jacketed cable is stiffer and more difficult to work with because it holds its previous position better.

DESCRIPTION OF THE PREFERRED EMBODIMENT

Figure 1:
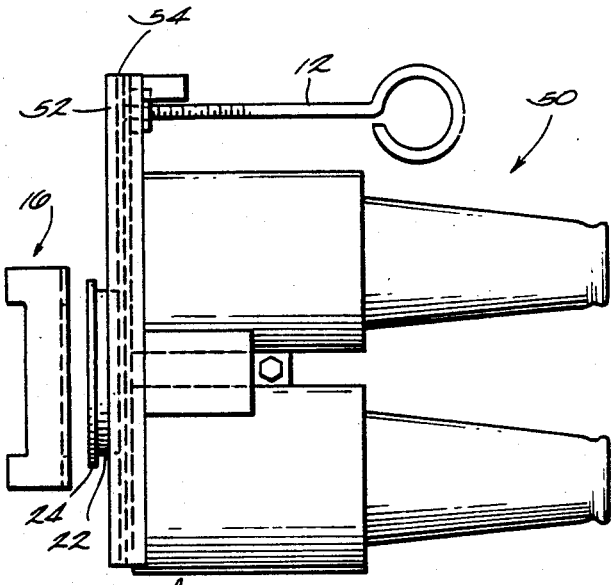
FIG. 1 is a side view of the variable portable feedthru device and an accessory bracket.
Figure 2:
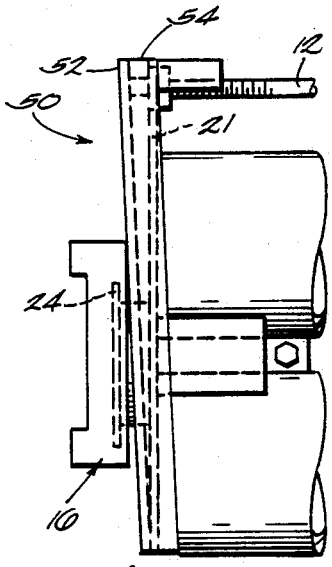
FIG. 2 is a side view of the variable portable feedthru device in an accessory bracket firmly secured by the back plate.
Figure 3:
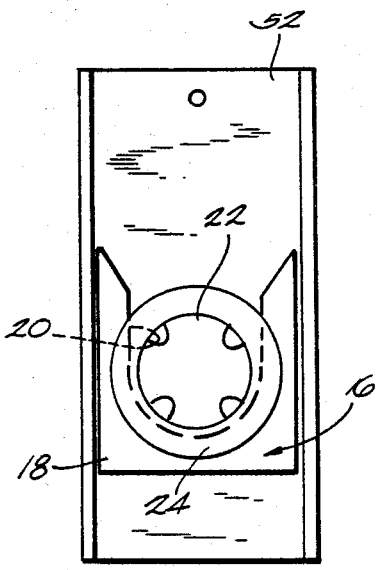
FIG. 3 is a rear view of the back plate and ring in an accessory bracket.
Figure 4:
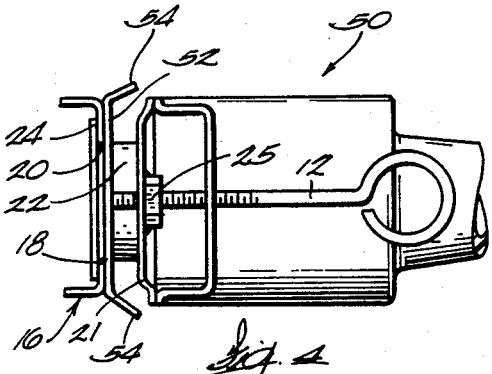
FIG. 4 is a top view of the variable portable feedthru device.
Figure 5:
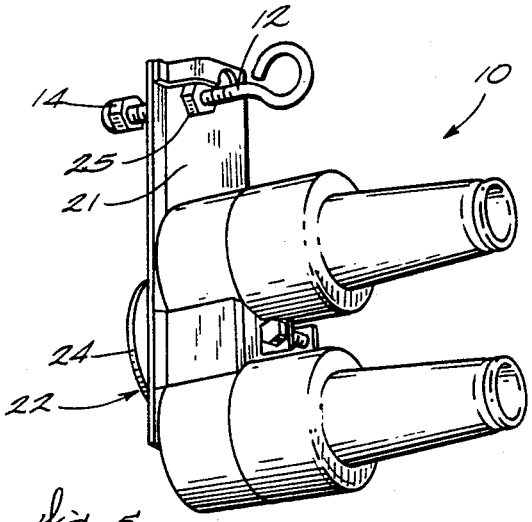
Fig. 5 PRIOR ART
FIG. 5 is a perspective view of a prior art feedthru device.

My invention is an improvement of RTE Corporation's vertical portable feedthru device 10 (FIG. 5). Portable feedthru devices, both vertical and horizontal, now depend on a stainless steel hold down bolt 12 with a pressure foot 14 to secure the feedthru device in the accessory bracket 16 of transformers, switching vaults, switching cabinets and other electrical apparatus. The accessory bracket 16 includes a plate 18 having therein an upwardly-opening, U-shaped slot 20. The Prior art feedthru device 10 includes a bracket or plate 21, and a male ring 22 which extends rearwardly from the bracket 21, which has thereon a flange portion 24 and which is slideably received in the slot 20 in the accessory bracket 16 with the flange portion 24 of the ring 22 located inside the bracket 16 or behind the plate 18. The flange portion 24 engages the plate 18 to prevent the feedthru device 10 from being pulled forwardly off the bracket 16. The hold down bolt 12 is threaded through a nut 25 which is mounted on the plate 21.

The feedthru device 10 is secured to the bracket 16 by turning the hold down bolt 12 to force the pressure foot 14 against the wall of the transformer or other electrical apparatus on which the bracket 16 is mounted. This forces the flange portion 24 of the ring 22 against the plate 18 and thereby secures the feedthru device 10 to the bracket 16.

Figure 6:
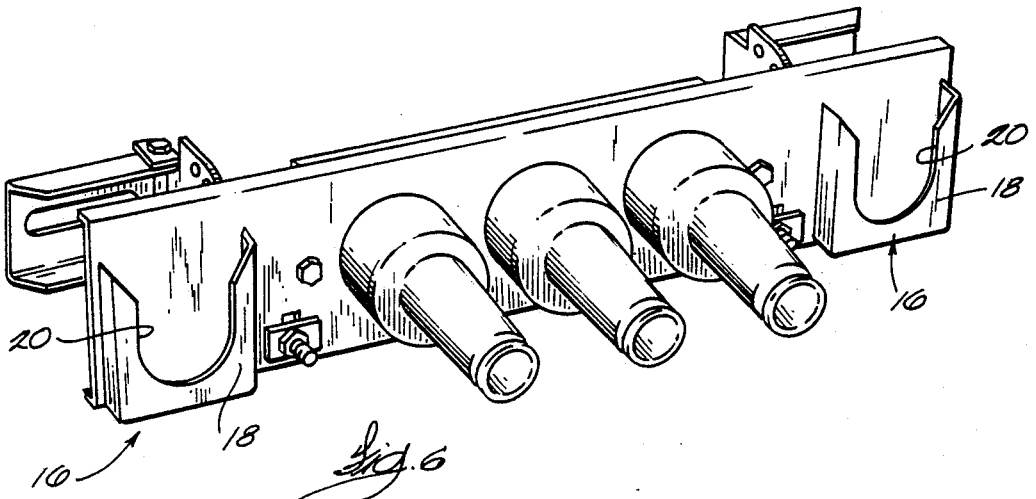
Fig. 6 PRIOR ART
FIG. 6 is a perspective view of a loadbreak junction including a pair of accessory brackets or parking stands.

Many of the accessory brackets do not have a means of accepting the hold down bolt with pressure foot so the feedthru device 10 is loose in the accessory bracket 16 and may come out when a high voltage cable is attached. For example, as shown in FIG. 6, a loadbreak junction does not provide a wall against which the pressure foot 14 can be tightened.

A feedthru device 50 embodying the invention is shown in FIGS. 1–4 The feedthru device 50 and the prior art feedthru device 10 have many common elements which have been given the same reference numerals.

My improvement (see FIGS. 1–4) is to remove the male ring 22 from the feedthru device 50, add a stainless steel back plate 52 with formed sides 54 and replace the original male ring 22 with a male ring 22 which is the thickness of the back plate 52 deeper than the original. I will remove the pressure foot from the hold down bolt 12 so the back plate 52 can float freely on the male ring 22. The sides 54 of the back plate 52 are formed so the back plate 52 will not rotate on the male ring 22. Now when the male ring 22 of the feedthru device 50 is placed in the female slot 20 of the accessory bracket 16 of any electrical apparatus and the hold down bolt 12 is tightened against the back plate 52, a binding action will take place between the feedthru device 50 and the accessory bracket 16 which will secure the feedthru device 50. More particularly, the hold down bolt 12 forces the back plate 52 away from the bracket 21 so that the plate 18 of the accessory bracket 16 is tightly sandwiched between the back plate 52 and the flange portion 24 of the ring 22. This binding action can take place with the feedthru device 50 in any rotational position, therefore the name Variable Portable Feedthru Device. As shown in the drawings, the feedthru device 50 does not engage the wall of the transformer or other electrical apparatus on which the accessory bracket 16 is mounted.

What is claimed is:

1. A feedthru device adapted to be mounted on an accessory bracket which includes a bracket plate and which is adapted to be mounted on the wall of an electrical apparatus, said feedthru device comprising a first plate, feedthru means mounted on said first plate, and means for fixedly securing said first plate to the accessory bracket plate by engaging only said first plate and the accessory plate so as to substantially prevent pivotal movement of said feedthru device relative to the accessory bracket plate.

2. A feedthru device as set forth in claim 1 wherein said means for fixedly securing said first plate to the accessory bracket plate clampingly engages the accessory bracket plate.

3. A device as set forth in claim 1 wherein said securing means includes a male member extending from said first plate and having thereon a flange portion spaced from said first plate, a second plate mounted on said male member for movement between said first plate and said flange portion, and means for selectively forcing said second plate toward said flange portion and away from said first plate.

4. A device as set forth in claim 3 wherein said means for forcing said second plate toward said flange portion includes a second member which has an end engageable with said second plate and which threadedly engages said first plate such that rotation of said second member relative to said first plate causes movement of said end toward said second plate and away from said first plate.

5. A feedthru device as set forth in claim 4 wherein said second member is spaced from said male member.

6. A feedthru device as set forth in claim 4 wherein said second member is a bolt.

7. An electrical device adapted to be mounted on an accessory bracket including a bracket plate having therein a U-shaped slot, said device comprising a first plate, a male member extending from said first plate and having thereon a flange portion spaced from said first plate, a second plate mounted on said male member for movement between said first plate and said flange portion, and means for selectively forcing said second plate toward said flange portion and away forcing said second plate toward said flange portion and away from said first plate so that, when said male member is received in the slot of the accessory bracket plate with the bracket plate between said flange portion and said second plate, the accessory bracket plate is fixedly secured between said second plate and said flange portion, said means for forcing said second plate toward said flange portion including a second member which has an end engageable with said second plate and which threadedly engages said first plate such that rotation of said second member relative to said first plate causes movement of said end toward said second plate and away from said first plate.

8. A device as set forth in claim 7 wherein said second member is spaced from said male member.

9. A device as set forth in claim 7 wherein said second member is a bolt.

10. A feedthru device adapted to be mounted on an accessory bracket which includes a bracket plate and which is adapted to be mounted on the wall of an electrical apparatus, said feedthru device comprising a first plate, feedthru means mounted on said first plate, and means for fixedly securing said first plate to the accessory bracket, said securing means including a male member extending from said first plate and having thereon a flange portion spaced from said first plate, a second plate mounted on said male member for movement between said first plate and said flange portion, and means for selectively forcing said second plate toward said flange portion and away from said first plate.

11. A feedthru device as set forth in claim 10 and adapted to be mounted on an accessory bracket including a bracket plate having therein a U-shaped slot, wherein the accessory bracket plate is fixedly secured between said second plate and said flange portion when said male member is received in the slot of the accessory bracket plate with the bracket plate between said flange portion and said second plate.

12. A feedthru device adapted to be mounted on an accessory bracket which including a bracket plate and which is adapted to be mounted on the wall of an electrical apparatus, said feedthru device comprising a first plate, feedthru means mounted on said first plate, and means for fixedly securing said first plate to the accessory bracket, said securing means including a male member extending from said first plate and having thereon a flange portion spaced from said first plate, a second plate mounted on said male member for movement between said first plate and said flange portion, and means for selectively forcing said second plate toward said flange portion and away from said first plate, said means for forcing said second plate toward said flange portion including a second member which has an end engageable with said second plate and which threadedly engages said first plate such that rotation of said second member relative to said first plate causes movement of said end toward said second plate and away from said first plate.

13. A device as set froth in claim 12 wherein said second member is spaced from said male member.

14. A device as set forth in claim 12 wherein said second member is a bolt.

15. A feedthru device adapted to be mounted on an accessory bracket which includes a bracket plate and which is adapted to be mounted on the wall of an electrical apparatus, the bracket plate having therein a U-shaped slot, said feedthru device comprising a first plate, feedthru means mounted on said first plate, and means for fixedly securing said first plate to the accessory bracket, said securing means including a male member extending from said first plate and having thereon a flange portion spaced from said first plate, a second plate mounted on said male member for movement between said first plate and said flange portion, and means for selectively forcing said second plate toward said flange portion and away from said first plate such that the accessory bracket plate is fixedly secured between said second plate and said flange portion when said male member is received in the U-shaped slot of the accessory bracket plate with the bracket plate between said flange portion and said second plate, said means for forcing said second plate toward said flange portion including a second member which has an end engageable with said second plate and which threadedly engages said first plate such that rotation of said second member relative to said first plate causes movement of said end toward said second plate and away from said first plate.

16. A device as set forth in claim 15 wherein said second member is space from said male member.

17. A device as set forth in claim 15 wherein said second member is a bolt.

* * * * *

UNITED STATES PATENT AND TRADEMARK OFFICE

CERTIFICATE OF CORRECTION

PATENT NO. : 4,921,433

DATED : May 1, 1990

INVENTOR(S) : Theodore M. Biren

It is certified that error appears in the above-identified patent and that said Letters Patent is hereby corrected as shown below:

Column 3, line 18, delete ---forcing said second plate toward said flange portion and away---.

Column 4, line 4, the word "including" should read ---includes---.

Signed and Sealed this

Eleventh Day of June, 1991

*Attest:*

HARRY F. MANBECK, JR.

*Attesting Officer*

*Commissioner of Patents and Trademarks*